US006799507B2

(12) United States Patent
Ohba et al.

(10) Patent No.: US 6,799,507 B2
(45) Date of Patent: Oct. 5, 2004

(54) WEB PRINTERS

(75) Inventors: Tetsuya Ohba, Hitachinaka (JP); Akitomo Kuwabara, Hitachinaka (JP)

(73) Assignee: Hitachi Printing Solutions, Ltd., Kanagawa-Pref. (JP)

( * ) Notice: Subject to any disclaimer, the term of this patent is extended or adjusted under 35 U.S.C. 154(b) by 331 days.

(21) Appl. No.: 09/927,391

(22) Filed: Aug. 13, 2001

(65) Prior Publication Data

US 2002/0033106 A1 Mar. 21, 2002

(30) Foreign Application Priority Data

Aug. 18, 2000 (JP) ..... 2000-248063

(51) Int. Cl.[7] ..... B41F 13/56

(52) U.S. Cl. ..... 101/228; 101/219; 101/220; 101/221; 101/225; 101/485; 400/613; 400/618; 400/619; 400/579; 400/583; 226/44; 226/15; 226/17

(58) Field of Search ..... 101/216, 219, 101/220, 221, 224, 225, 227, 228, 231, 485, 486; 400/613, 618, 619, 579, 583; 242/418.1; 226/44, 15, 16, 17, 18, 19, 20, 21, 22, 23, 42, 43, 118.4

(56) References Cited

U.S. PATENT DOCUMENTS 3,561,654 A * 2/1971 Greiner ..... 226/25
4,480,801 A * 11/1984 Stone ..... 242/532.7
5,774,777 A 6/1998 Ohtsuka et al.
5,947,617 A * 9/1999 Kondo ..... 400/579
6,052,144 A * 4/2000 Reyner ..... 347/262
6,134,406 A * 10/2000 Moe et al. ..... 399/165
6,279,807 B1 * 8/2001 Crowley et al. ..... 226/31
6,321,650 B1 * 11/2001 Ogawa et al. ..... 101/227
6,564,710 B1 * 5/2003 Mathea ..... 101/227
6,592,276 B2 * 7/2003 Ohba et al. ..... 400/582
6,601,951 B2 * 8/2003 Kuwabara et al. ..... 347/101
2003/0116042 A1 * 6/2003 Ohba et al. ..... 101/225

FOREIGN PATENT DOCUMENTS

| | | |
|---|---|---|
| DE | 197 49 603 A1 | 5/1999 |
| WO | WO 95/19929 | 7/1995 |
| WO | WO 98/18056 | 4/1998 |

* cited by examiner

*Primary Examiner*—Andrew H. Hirshfeld
*Assistant Examiner*—Kevin D. Williams
(74) *Attorney, Agent, or Firm*—Antonelli, Terry, Stout & Kraus, LLP

(57) ABSTRACT

A web printer has a buffer for adjusting the traveling position of the web under its slack status, a tension assigning unit for assigning fixed tension to the web delivered from the buffer, a device for detecting the traveling position of the web delivered from the tension assigning unit, a sew correction unit for adjusting the skew of the web according to the output from the detection device, and an image forming unit that forms images on the web.

6 Claims, 3 Drawing Sheets

WEB PRINTERS

BACKGROUND OF THE INVENTION

The present invention relates to web printers of the type that form images on webs carried at high speed.

RELATED BACKGROUND ART

In the general types of printers that form, images on webs, pin members of a tractor mechanism mounted on the printer are engaged with the feed holes disposed along the edges of the web, and the tractor mechanism is driven to feed the web as an image is formed thereon using the image forming section of the printer. After the web with the feed holes has been printed, however, the portions of the web along which these feed holes are disposed (usually along the left and right edges of the web) need to be cut off, and thus an increased time is spent after printing in obtaining the final printed matter. Also, the printer itself requires a tractor mechanism as a component thereof, which inherently results in a complex configuration. Such a cutting operation as mentioned above can be omitted by adopting webs that are free of feed holes, using a web feed roller mechanism instead of a tractor mechanism of the printer.

In this regard, for a printer that uses webs that are free of feed holes and which forms an image on a web while feeding it by use of a feed roller mechanism, if this printer is of the type which operates in no higher than a middle-speed region in which only about 50 pages per minute are printed on A4-paper on a horizontal feed basis, printing not conspicuous in terms of print position offsets is possible since not too significant slipping occurs between the web and the feed rollers. If, however, the printer is of the high-speed type that is capable of printing more than 100 pages per minute or is of the ultrahigh-speed region type capable of printing more than 200 pages per minute, it is difficult with a conventional configuration to feed the web to the image forming section accurately; and, even when extremely thin paper, such as is often used for a dictionary, for example, is fed at a rate as high as more than 100 pages per minute, the need arises to very accurately control the tension, traveling position, etc. of the web being fed.

SUMMARY OF THE INVENTION

The object of the invention is to provide a printer that, irrespective of the web type, enables stable feed of the web at high speed and with high accuracy.

The object set forth above can be achieved by providing a printer having a buffer for adjusting the traveling position of the web under its slack status, a tension assigning unit for assigning fixed tension to the web delivered from said buffer, a device for detecting the traveling position of the web delivered from said tension assigning, a skew correction unit for adjusting the skew of said web according to the output from said detection unit, and an image forming unit that forms images on the web delivered from said skew correction unit.

DETAILED DESCRIPTION OF PREFERRED EMBODIMENTS

Figure 1:
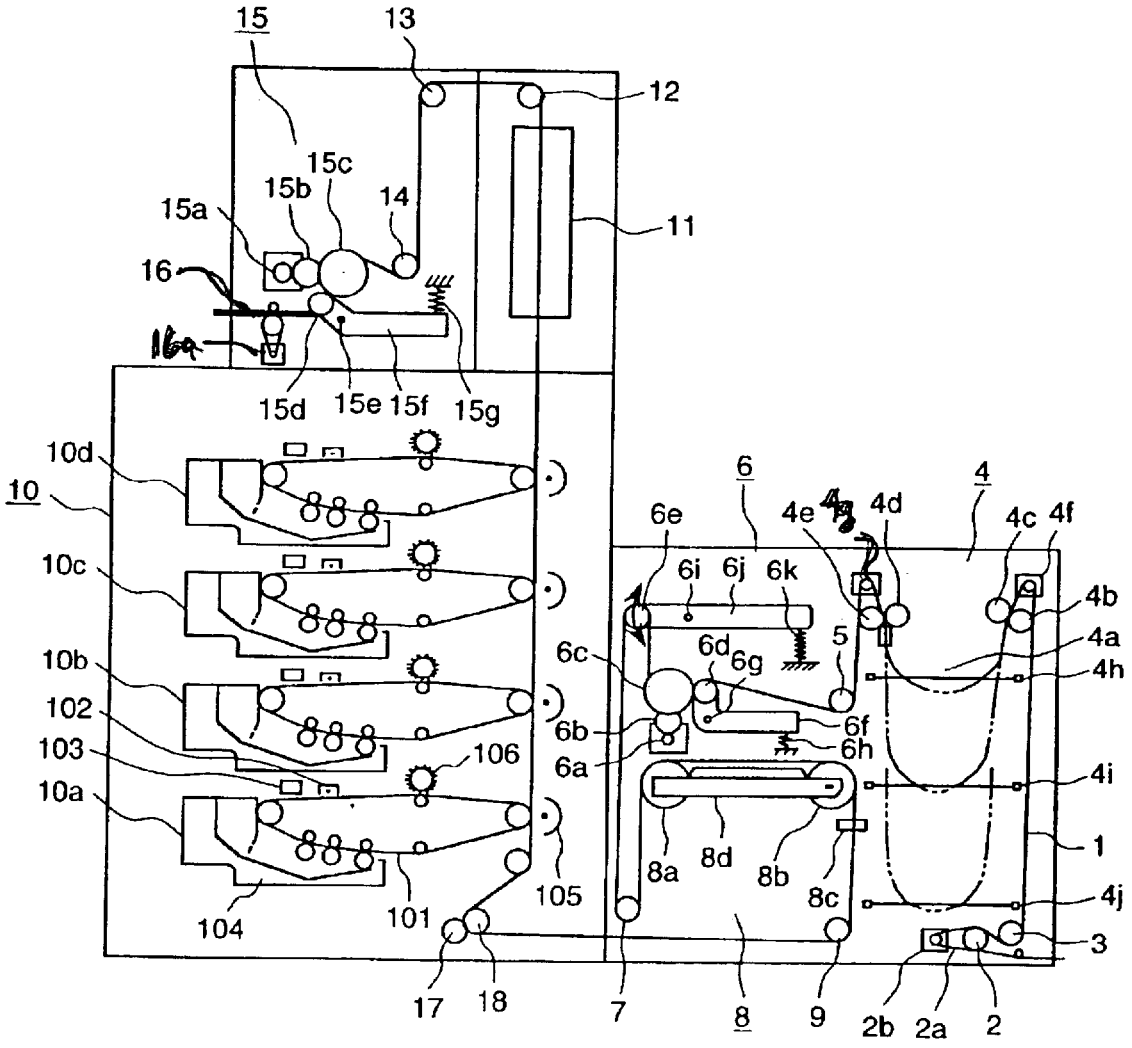
FIG. 1 is an overall block diagram of the printer representing an embodiment of the present invention.

An embodiment of the present invention will be described below with reference to the drawings. FIG. 1 is a schematic diagram showing an embodiment of the printer according to the present invention.

Numeral 1 in FIG. 1 denotes a web. Web 1 may be made from paper, a plastic film, or the like. Web 1 is inducted into a buffer unit 4 via guide rollers 2 and 3 arranged on the web feed route; the guide roller 2 is connected to a motor 2*b* via a timing belt 2*a* and is rotationally driven at a surface velocity higher than the feed rate of web 1 and in the same direction as the feed direction of the web.

The buffer unit 4 is equipped with a storage area 4*a* for temporarily storing the web 1 being fed, one pair of rollers 4*b* and 4*c* provided at the web loading section with respect to the storage area 4*a*, one pair of rollers 4*d* and 4*e* provided at the web unloading section with respect to the storage area 4*a*, motors 4*f* and 4*g* for driving the rollers 4*b* and 4*e*, respectively, and a plurality of sensors (in this embodiment, three pairs of optical sensors 4*h*, 4*i*, and 4*j*) for monitoring the amount of slack of the web 1 in the storage area 4*a*.

The rotational speeds of the rollers 4*b* and 4*e* are controlled via the motors 4*f* and 4*g* according to the particular output of each sensor so that the amount of slack of the web 1 in the storage area 4*a* is restricted to stay within a predetermined allowable range. It is desirable for the roller 4*e* and the motor 4*g* to be provided so as to keep constant the torque being generated and conduct stable control of the torque required for the rotation of the roller 4*e*.

In the vicinity of the rollers 4*d* and 4*e*, located at the web unloading section of the buffer unit 4, there is provided a guide member 4*k* that restricts the edge positions of the web 1 being fed. Since the guide member 4*k* acts on the web existing under a stack status, the traveling position of the web 1 in contact with the guide member 4*k* is easily adjusted. In this embodiment, the guide member 4*k* is provided so that the skewing width in the feed direction of the web can be restrained with a maximum margin of about 1 mm during the start of feed (this margin during stabilized feed can be about 0.5 mm). The tension of the web 1 at the initial phase of its feed is determined by the torque generated at the roller 4*e* and the take-up angle of the web with respect to guide roller (fixed roller) 5, and the lateral skew angle of the web can be restrained to a certain extent.

After web 1 has been pulled out from the buffer unit 4, the web is fed into a tension assigning unit 6 via the guide roller 5 mentioned above. The tension assigning unit 6 consists of an infeed roller 6*c* driven by a motor 6*a* via a gear 6*b*, a pressure roller 6*d* provided so as to be press-fittable against the infeed roller 6*c*, and a dancer roller 6*e* supported movably on the web feed route.

The pressure roller 6*d* is provided at one end of an arm 6*f* supported so as to permit oscillation thereof about a shaft 6*g*, and it is pressed against the infeed roller 6*c* by the elastic force of a spring 6*h* provided at the other end of the arm 6*f*. The dancer roller 6*e* is provided at one end of an arm 6*j* that is supported so as to permit oscillation thereof about a shaft 6*i*, and it is constructed so that any slight differences in the feed rate of the web being fed are absorbed by the elastic force of a spring 6*k* provided at the other end of the arm 6*j*. The oscillating position of the arm 6*j* is monitored by a sensor 6*m*, and the rotation of the infeed roller 6*c* is controlled according to the particular position of the arm 6*j*, namely, the particular output level of the sensor 6*m*. In accordance with the present invention, the dancer roller 6*e* plays an important role in controlling the tension of the web 1 between the infeed roller 6*c* and an outfeed roller 15*c* (described in detail later in this document). That is to say, an image forming section 10 is located between the infeed roller 6*c* and the outfeed roller 15*c*, and this means that, if highly accurate tension control cannot be conducted at the dancer roller 6*e*, the printer will incur the fatal problem that image components of each color are transferred under a position-offset status on the web. In this embodiment, therefore, the tension of the web 1 between the infeed roller 6*c* and the outfeed roller 15*c* is adjusted by the dancer roller 6*e* so as to stay within the range from 30 to 200 N, depending on the ream weight and width of the print paper.

After that, the web 1 that was pulled out from the tension assigning unit 6 is fed into a skew correction unit 8 via a guide roller 7. The skew correction unit 8 is composed of two position-restricting rollers 8*a* and 8*b* provided in parallel, a sensor 8*c* for detecting the edge position of the web 1, and a driving motor 8*d*. The two position-restricting rollers 8*a* and 8*b* are supported so that they can be rotationally moved under their parallel status by a frame 8*d*, and these rollers are provided so that both can be inclined together to the required angle by rotating the frame 8*d* through an angle based on the output level of the sensor 8*c*.

The web 1 that has been passed through the skew correction unit 8 is fed into the image forming section 10 via a guide roller 9. Although the present invention is not limited to use of a particular image forming section 10, this embodiment exemplifies an image forming section of the type which forms toner images on the photosensitive material by use of known electrophotographic processes, and employs a configuration where color images are formed on one side of the web 1 by four imaging portions, 10*a*, 10*b*, 10*c*, and 10*d*.

The structure of the imaging portions will be described below taking imaging portion 10*a* as an example. Numeral 101 in the figure denotes a photosensitive material belt. When the photosensitive material belt 101 starts rotating, a high voltage is applied to a corona charger 102 and the surface of the photosensitive material belt 101 is uniformly charged. The laser beam that has been emitted from a light source 103, including a semiconductor laser, photo-emitting diodes, etc., provides the surface of the photosensitive material belt 101 with image exposure and forms an electrostatic latent image on the photosensitive material belt 101. When the photosensitive material belt area holding this latent image reaches a position that faces an image developing unit 104, a developing agent is supplied to the electrostatic latent image and a toner image is formed on the photosensitive material belt 101. The toner image that has been formed on the photosensitive material belt 101 is attracted onto web 1 by the action of a transfer unit 105, by which a charge of opposite polarity to that of the toner image is assigned to the reverse side of web 1. The area that has passed the transfer position of the photosensitive material belt 101 is cleaned by a cleaning unit 106 in order to prepare for the next printing operation.

In the way described above, after the toner image has been transferred from the four imaging portions, 10*a*, 10*b*, 10*c*, and 10*d*, to web 1, the toner image is fixed by the passage of the web through a heater 11, and the web is unloaded from the printer via guide rollers 12, 13, and 14, an outfeed roller mechanism 15, and a puller 16. After this, the web is carried to a post-processor (not shown in the figure), where the printer then performs the required processes, such as cutting, stapling, and punching, on the web in order to complete the series of operations.

In this embodiment, the outfeed roller mechanism 15 is constructed similarly to the infeed roller mechanism mentioned earlier, and it consists of an infeed roller 15*c*, which is driven by a motor 15*a* and a gear 15*b*, and a pressure roller 15*d*, which is provided press-fittably with respect to the infeed roller 15*c*, wherein the pressure roller 15*d* is provided at one end of an arm 15*f* supported so as to permit its oscillation about a shaft 15*e*, and is pressed against the infeed roller 15*c* by the elastic force of a spring 15*g* provided at the other end of the arm 15*f*.

Figure 2:
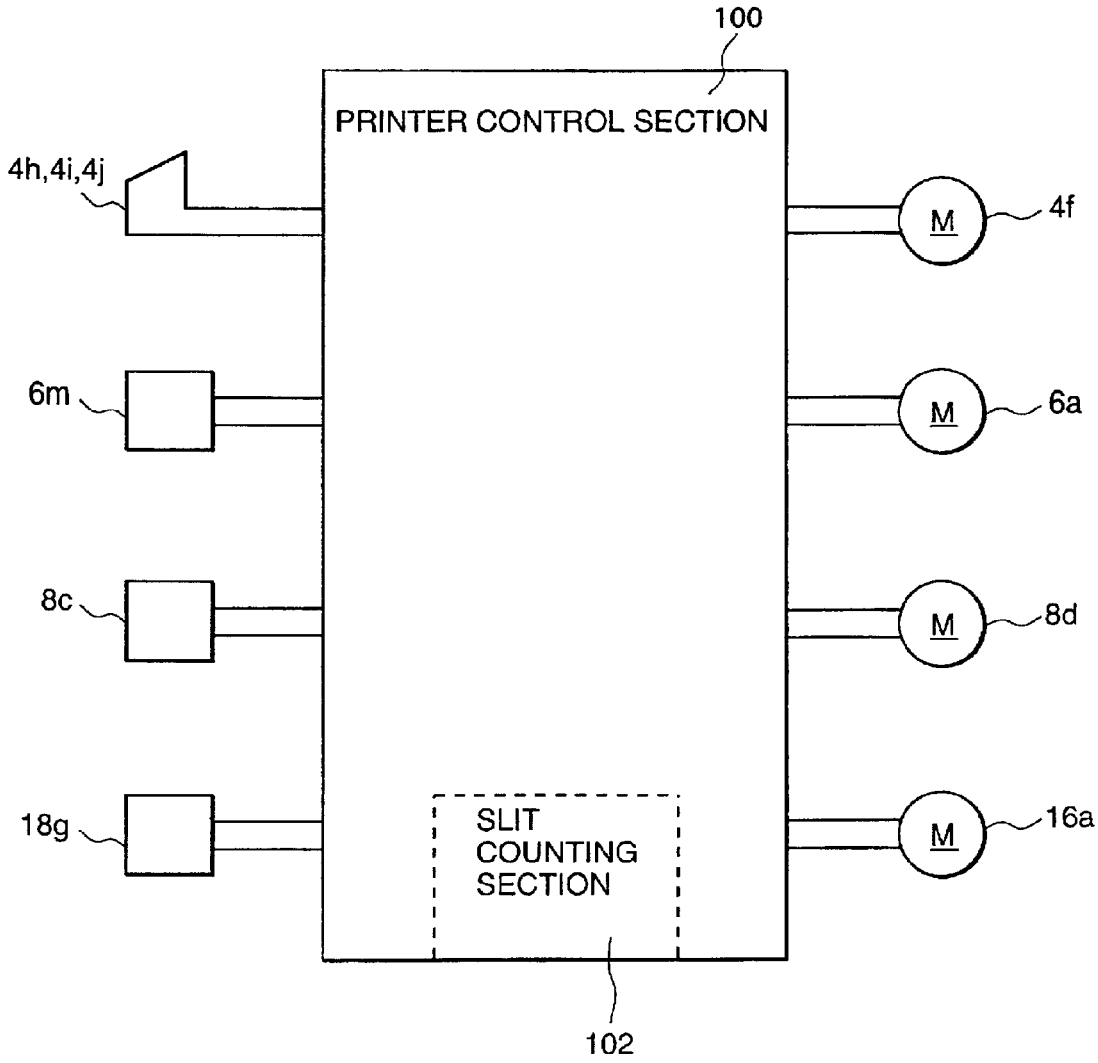
FIG. 2 is a diagram showing the configuration of the control section in the embodiment of FIG. 1.

The printer in this embodiment is controlled by a control section 100. How the loop feed motor 4*f*, the infeed motor 6*a*, the driving motor 8*d* of the skew correction unit 8, and the outfeed motor 15*a* are controlled by the control section 100 will be described with reference to FIG. 2.

The loop feed motor 4*f* is driven so that its rotational speed changes according to the particular area of a print paper separating sensor on the basis of the digital signals of loop buffer storage volume monitoring switches (for example, optical sensors) 4*h* and 4*j*.

The infeed motor 6*a* has its rotation controlled according to the particular notch position of an encoder 6*m* provided at the dancer roller 6*e*, and it is driven so as to keep the position of the dancer roller 6*e* (that is to say, the tension of the print paper) constant.

The driving motor 8*d* of the skew correction unit 8 is driven according to the particular output level of the paper edge detection sensor 8*c*, and it controls the position of the paper unloaded from the skew correction unit 8. Thus, the position of the paper fed to the image forming unit 10 is maintained stably.

The number of slits in the encoder 18*g* of a speed detection roller 18 during a fixed time is counted by a slit counting section 102. The speed of the outfeed motor 15*a* is changed according to the particular count value in order to minimize the effects of the constriction of the paper at fixing section 11 and the effects of increases in the circumferential speed of the outfeed roller 15*c*, associated with the heating of the outfeed roller. That is to say, the effects of the heat generated by the fixing section 11 can be suppressed by changing the speed of the outfeed motor 15*a*.

The heater 11 has a plurality of heating plates so that it can supply thermal energy to web 1, and this heater maintains its internal air temperature in the range from 150 to 350 degrees C. and heats the web 1. If the image forming section uses ink jet processing, rather than electrophotographic processing, the heater 11 can be used as a means of drying the ink image recorded and formed on the web 1 during ink jet processing, and the internal air temperature of the heater 11 in that case is managed to stay within the range from about 40 to 150 degrees C.

Numeral 16*a* in FIG. 1 denotes the motor for driving the roller which constitutes the puller 16; and, similarly, numerals 17 and 18 denote the pressure roller and the speed detection roller, respectively, wherein the pressure roller 17 and the speed detection roller 18 are constructed as the so-called "coupled rotating rollers" that rotate simultaneously when coming into contact with the web 1 fed to both. Also, the rotating shaft of the speed detection roller 18 has a slit-provided disc (encoder 18*g*) and is so constructed as to detect the corresponding slits by use of optical sensors or the like. The rotational speed of the outfeed roller 15*c* is controlled by the control section 100 of the printer in accordance with the output signals of the above-mentioned optical sensors within a preset period, and thus the tension of the web passed through the image forming unit 10 is controlled. That is to say, when a signal indicating that the feed status of the web has been detected in its delay direction is obtained from the speed detection roller 18, the rotational speed of the outfeed roller 15*c* is increased, and in the opposite case, the rotational speed of the outfeed roller 15*c* is reduced.

According to the printer having the above configuration, since web tension between the infeed roller 6*c* and the outfeed roller 15*c* is controlled by the dancer roller 6*e*, and thus the feed of the web 1 passed through the image forming section 10 can be stabilized, high-quality color printing not prone to shifting in terms of image position can be implemented.

Figure 3:
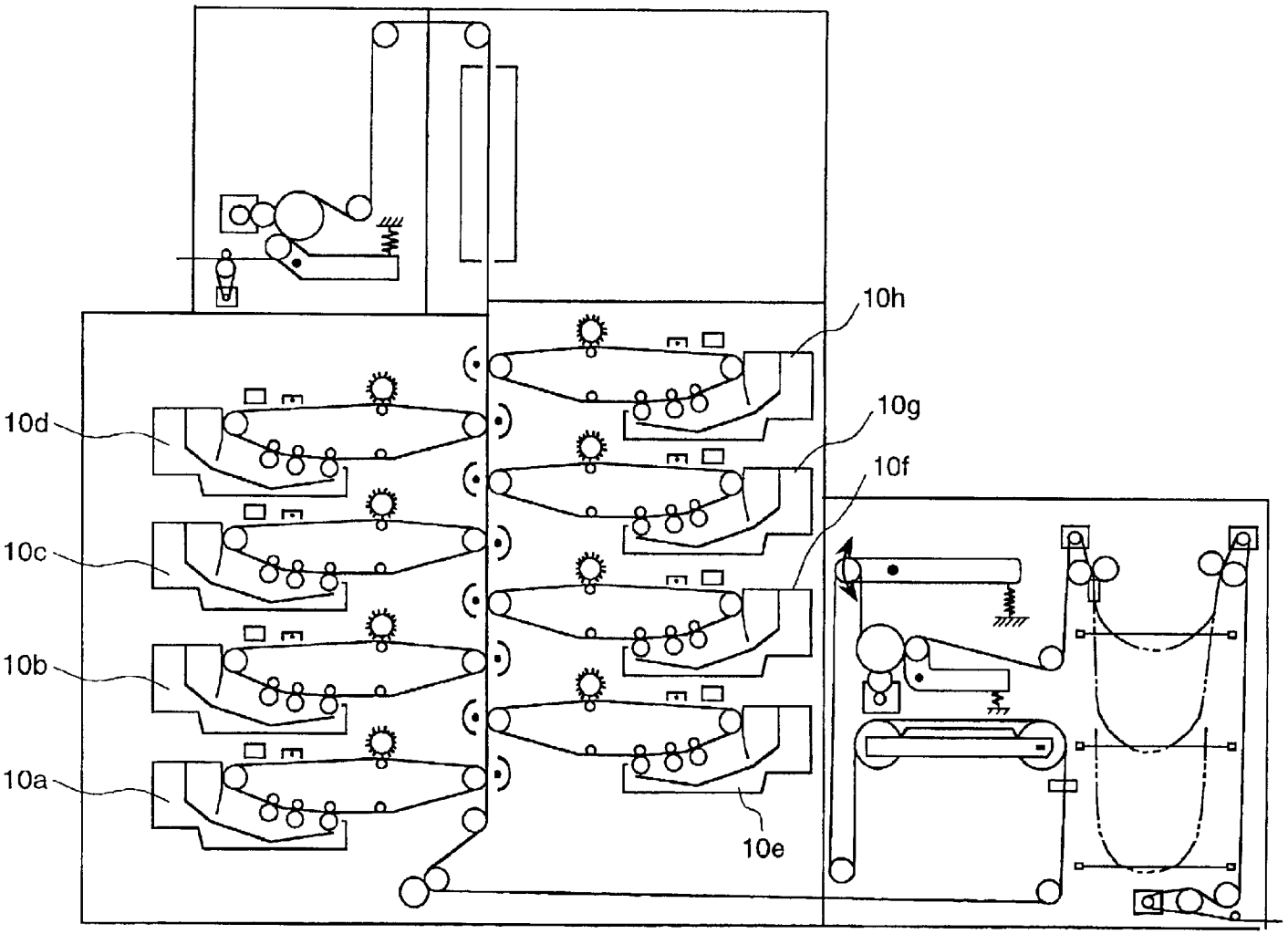
FIG. 3 is an overall block diagram of another embodiment of the present invention.

Although the description set forth above assumes a configuration in which four imaging portions are arranged in line on one side of the web, four imaging portions can also be arranged on the other side of the web to apply the present invention to a printer capable of forming color images on both sides of the web. In this case, arranging at alternately different height levels the four imaging positions provided on one side of the web 1, namely, 10*a*, 10*b*, 10*c*, and 10*d*, and the four imaging positions provided on the other side of the web 1, namely, 10*e*, 10*f*, 10*g*, and 10*h*, as shown in FIG. 3, enables the printer to be practical because the height of the printer can be prevented from increasing too greatly and because its design can be made compact.

As set forth above, according to the present invention, high-speed and highly accurate feed of the web that passes through the image forming unit can be stabilized, irrespective of the web type, since the web printer has a buffer for adjusting the traveling position of the web under its slack status, a tension assigning unit for assigning fixed tension to the web delivered from said buffer, a device for detecting the traveling position of the web delivered from said tension assigning unit, a skew correction unit for adjusting the skew of said web according to the output from said detection unit, and an image forming unit that forms images on the web.

What is claimed is:

1. A web printer comprising:

a buffer means for adjusting a traveling position of a web under a slack status thereof;

infeed rollers for holding from both sides, and carrying, the web delivered from said buffer means;

detection means for detecting the traveling position in a width direction of the web;

skew correction means for adjusting the traveling position in the width direction of the web according to an output from said detection means;

a dancer roller which is provided between said infeed rollers and said skew correction means and applies variable tension on the web according to a position thereof;

infeed roller control means which stabilizes said dancer roller at a desired position;

image forming means provided at an after-stage of said skew correction means in order to form an image on the web;

fixing means which is provided at an after-stage of said image forming means and fixes the image on the web;

outfeed rollers which are provided at an after-stage of said fixing means and discharge the web outside the web printer;

web feed rate detection means provided at a fore stage of said image forming means; and outfeed roller controller means which control rotational speed of said outfeed rollers according to an output of said web feed rate detection means.

2. The web printer according to claim 1, wherein said image forming means further includes a plurality of image forming portions arranged along a web feed route.

3. The web printer according to claim 1, wherein said image forming means further includes a plurality of image forming portions arranged on both sides of a web surface along a web feed route.

4. The web printer according to claim 3, wherein said plurality of image forming portions which are provided on one side of the web surface and said plurality of image forming portions provided on an other side of the web surface are arranged at alternately different height levels.

5. The web printer according to claim 1, wherein said image forming means is an electrophotographic unit, and the web printer is an electrophotographic web printing apparatus.

6. The web printer according to claim 1, wherein said web feed rate detection means is provided at an after-stage of said skew correction means.

* * * * *